US012121130B2

(12) United States Patent
Hsu

(10) Patent No.: US 12,121,130 B2
(45) Date of Patent: Oct. 22, 2024

(54) ATOMIZATION DEVICE FOR A HAIR DRYER

(71) Applicant: Shih-Ling Hsu, Tainan (TW)

(72) Inventor: Shih-Ling Hsu, Tainan (TW)

( * ) Notice: Subject to any disclaimer, the term of this patent is extended or adjusted under 35 U.S.C. 154(b) by 987 days.

(21) Appl. No.: 17/116,012

(22) Filed: Dec. 9, 2020

(65) Prior Publication Data

US 2022/0175107 A1 Jun. 9, 2022

(51) Int. Cl.
*A45D 20/12* (2006.01)

(52) U.S. Cl.
CPC ..... *A45D 20/12* (2013.01)

(58) Field of Classification Search
USPC ..... 392/380; 219/221, 222
See application file for complete search history.

(56) References Cited

U.S. PATENT DOCUMENTS

| | | | | | |
|---|---|---|---|---|---|
| 3,854,489 | A * | 12/1974 | Doyle | A45D 20/50 | 132/118 |
| 4,605,019 | A * | 8/1986 | Reynolds | A45D 20/12 | 34/96 |
| 2014/0013607 | A1* | 1/2014 | Funayama | A45D 20/12 | 34/60 |

FOREIGN PATENT DOCUMENTS

| | | | | |
|---|---|---|---|---|
| CN | 106388214 | A | * | 2/2017 |
| CN | 212325740 | U | * | 1/2021 |
| CN | 213882110 | U | * | 8/2021 |
| CN | 214630581 | U | * | 11/2021 |
| JP | 2021184937 | A | * | 12/2021 |
| JP | 2021191492 | A | * | 12/2021 |
| KR | 102352996 | | * | 1/2022 |
| KR | 102352996 | B1 | * | 1/2022 |
| TW | M594883 | | * | 5/2020 |

* cited by examiner

*Primary Examiner* — Sang Y Paik
(74) *Attorney, Agent, or Firm* — Best & Flanagan LLP

(57) ABSTRACT

A hair dryer includes a body having a housing with an air outlet. A heating and blowing device is mounted in the housing and is configured to guide in ambient cold air, to heat the cold air, and to guide heated air out of the housing via the air outlet. A control device controls operation of the heating and blowing device. An annular cap is disposed at the air outlet and includes a central portion having a passageway. An atomization device includes an atomizer and a chamber. The atomizer is disposed on the annular cap and includes a spray hole for ejecting a spray towards the passageway. The atomizer is electrically connected to the control device of the body. The chamber is located in the body or the annular cap, receives a liquid, and guides the liquid to the atomizer.

7 Claims, 7 Drawing Sheets

ATOMIZATION DEVICE FOR A HAIR DRYER

BACKGROUND OF THE INVENTION

The present invention relates to an atomization device for a hair dryer and, more particularly, to an atomization device that can be mounted on a hair dryer and can provide sprays to hair.

A hair dryer is an electrical appliance frequently used in daily lives and can shape beautiful hairstyles in addition to drying hair. To improve the hair quality, a reservoir is disposed in a hair dryer and is connected to a spraying tube. Water, a hair conditioner, an essential oil, or other liquids can be received in the reservoir. When the hair dryer is blowing out hot air, the liquid in the reservoir is ejected forward via the spraying tube to provide a hair caring function.

However, the drops outputted from the spraying tube are large and, thus, are difficult to be uniformly distributed to the hair and are difficult to be absorbed. Furthermore, the reservoir is fixed in the hair dryer and, thus, cannot be used on other hair dryers.

To increase the application, an atomization device is disposed on top of a housing of a hair dryer and includes a reservoir and an atomizer. A liquid in the reservoir flows to the atomizer and is atomized before it is discharged to the outside. However, the droplets of the spray mist outputted from the atomization device are large and, thus, difficult to be absorbed. Furthermore, the discharge distance of the spray mist is short, such that the spray mist is unstable and is difficult to be sprayed to the hair when the hair dryer has a larger spacing to the hair.

BRIEF SUMMARY OF THE INVENTION

An objective of the present invention is to provide an atomization device with better applications in installation while providing stable sprays to the hair.

A hair dryer according to the present invention comprises a body, an annular cap, and an atomization device. The body includes a housing, a heating and blowing device, and a control device. The housing includes a front end having an air outlet which is annular. The heating and blowing device is mounted in the housing and is configured to guide in ambient cold air, to heat the cold air, and to guide heated air out of the housing via the air outlet. The control device is configured to connect with a power and is configured to control operation of the heating and blowing device. The annular cap is disposed at the air outlet of the body. The annular cap includes a central portion having a passageway. The annular cap further includes a connecting portion. The atomization device includes an atomizer and a chamber. The atomizer is disposed on the connecting portion of the annular cap and includes a spray hole configured to eject a spray towards the passageway. The atomizer is electrically connected to the control device of the body via a wire. The chamber is located in the body or the annular cap, is configured to receive a liquid, and is configured to guide the liquid to the atomizer.

In an example, the annular cap further includes a connecting seat. The housing includes an opening at a top face of a front side thereof. A lid is disposed at the opening to open or close the opening. The chamber is formed in a container disposed below the opening and having an outlet port for outputting the liquid. The connecting seat is disposed on an upper side of the annular cap and is aligned with the opening of the housing of the body. The connecting seat includes a guiding groove at an upper side thereof for guiding the liquid in the container. The connecting portion is disposed at a lower side of the connecting seat and includes a through-hole communicating with the guiding groove.

In an example, the spray hole of the atomizer is configured to discharge the spray downwardly towards the passageway of the annular cap. The annular cap includes an outer ring coupled to the air outlet of the body and an inner ring radially inwards of the outer ring. A collection groove is formed between the outer ring and the inner ring and is annular and sealed. The outer ring includes a lower end having a collecting hole intercommunicating with the collection groove. The annular cap includes a discharge hole aligned with the collection groove. A plug is received in the discharge hole.

In an example, the control device of the body includes an electrically conductive magnetic ring at a location corresponding to the air outlet. An electrically conductive board is disposed at a rear end of the annular cap and is electrically connected to the electrically conductive magnetic ring and the wire of the atomizer.

In another example, the annular cap includes an outer ring coupled to the air outlet of the body and an inner ring radially inwards of the outer ring. A collection groove is formed between the outer ring and the inner ring and is annular and sealed. The collection groove receives the chamber. A filling port is disposed in the outer ring or the inner ring and intercommunicates with the chamber. A plug is disposed in the filling port. The connecting portion is disposed on the inner ring and includes a through-hole intercommunicating with the chamber.

In use, the annular cap is disposed at the air outlet of the body, and the electrically conductive board of the annular cap is attracted to and electrically connected to the electrically conductive magnetic ring, providing convenient electrical connection. Furthermore, a proper liquid is received in the chamber of the container, the container is placed into the housing of the body via the opening, and the lid is then closed. The liquid in the chamber can be guided to the atomizer via the outlet port.

A user can operate the control device to simultaneously activate the heating and blowing device and the atomizer. The liquid in the chamber is guided to the atomizer and is atomized to form a spray mist at the spray hole. The spray mist is ejected downwards towards the passageway. The heating and blowing device generates hot wind that is blown forwardly towards the air outlet and the passageway. The hot wind, which is substantially perpendicular to the spray mist, can further heat the atomized liquid into smaller droplets that are blown to the hair and the inside of the hair at a faster speed so as to be absorbed by the skin and the hair, providing a better hair caring effect. The container of the hair dryer according to the present invention can be easily removed to receive a proper liquid (such as a hair conditioner), providing better applications.

The present invention will become clearer in light of the following detailed description of illustrative embodiments of this invention described in connection with the drawings.

DETAILED DESCRIPTION OF THE INVENTION

Figure 1:
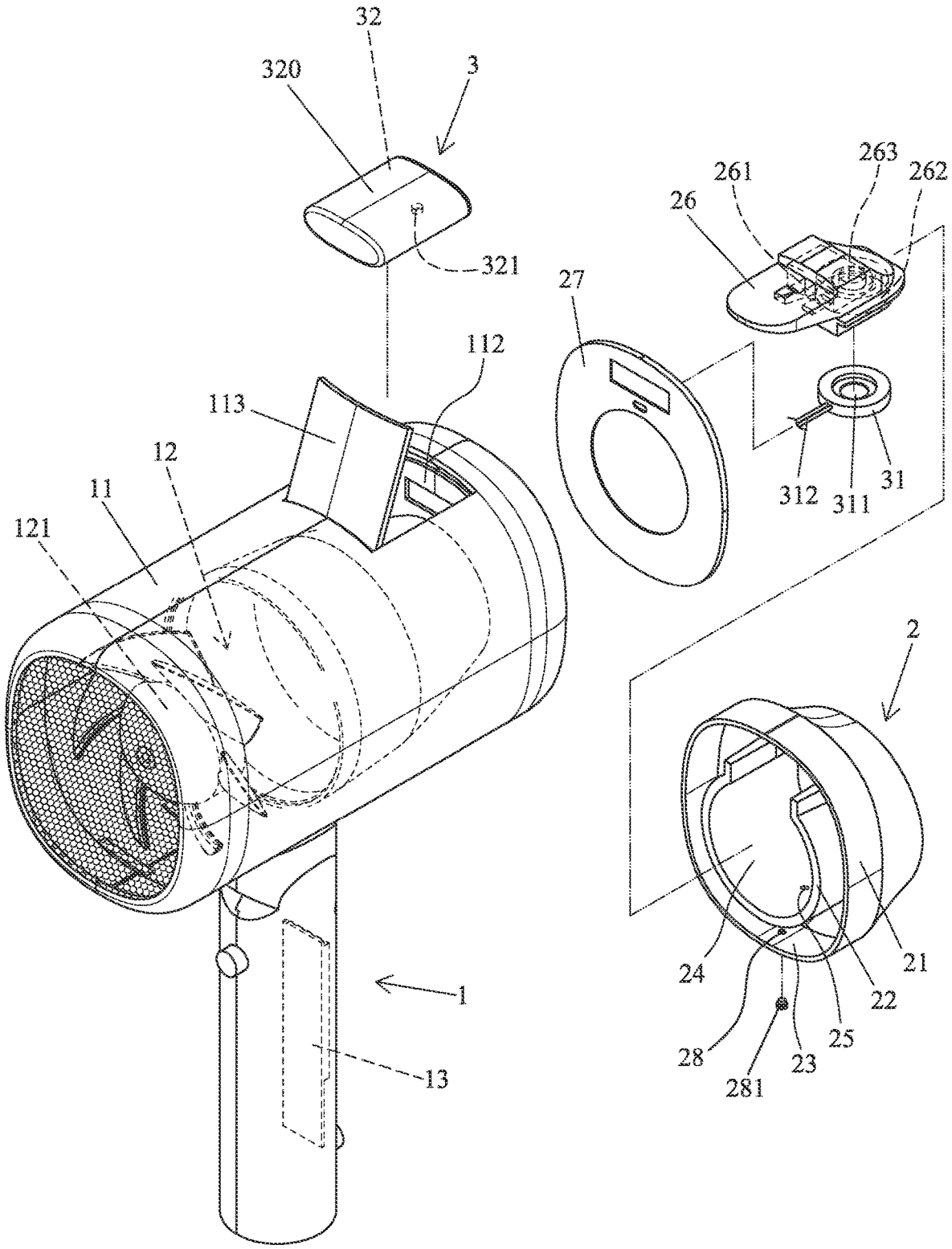
FIG. 1 is an exploded, perspective view of a hair dryer with an atomization device of a first embodiment according to the present invention.
Figure 2:
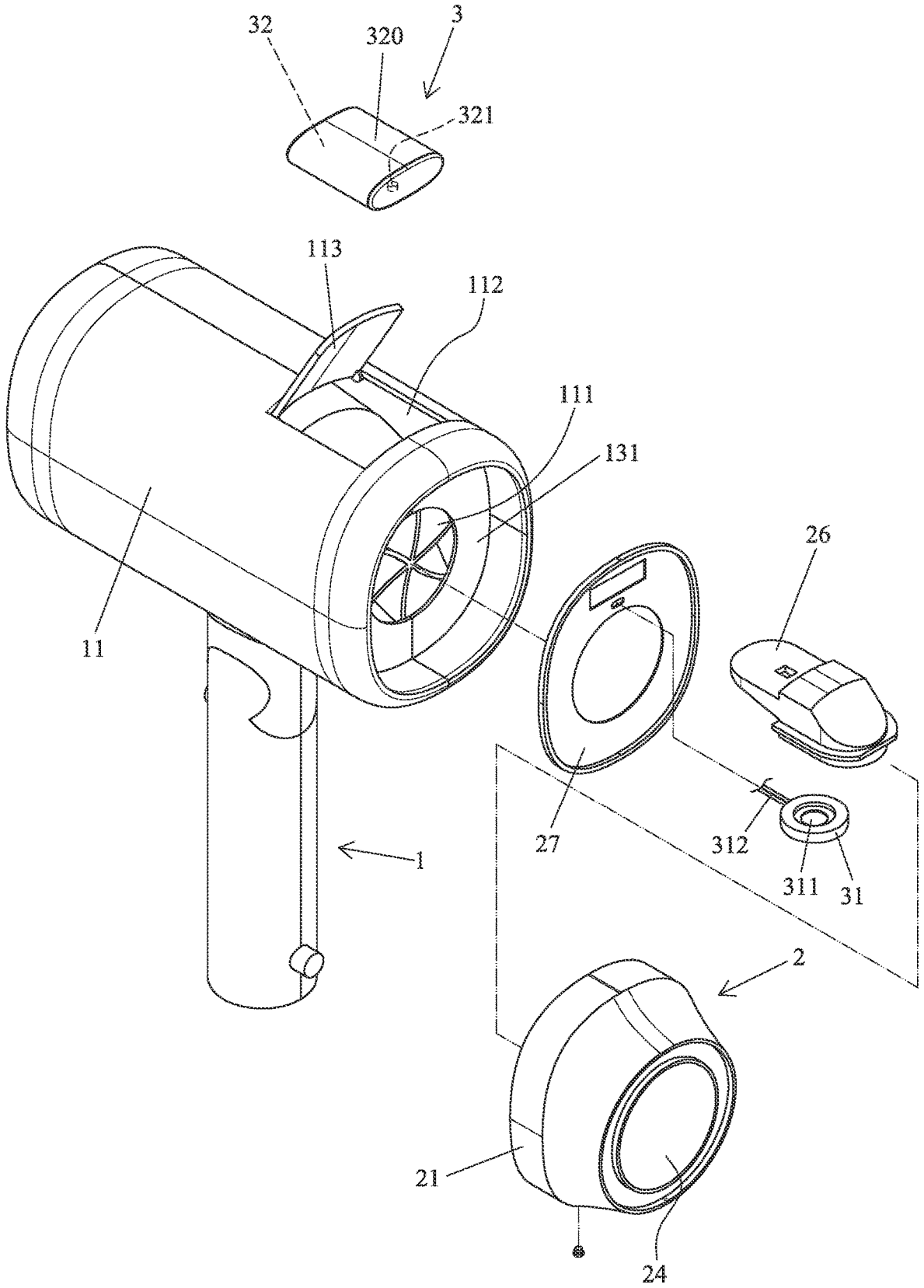
FIG. 2 is another exploded, perspective view of the hair dryer of the first embodiment according to the present invention.
Figure 3:
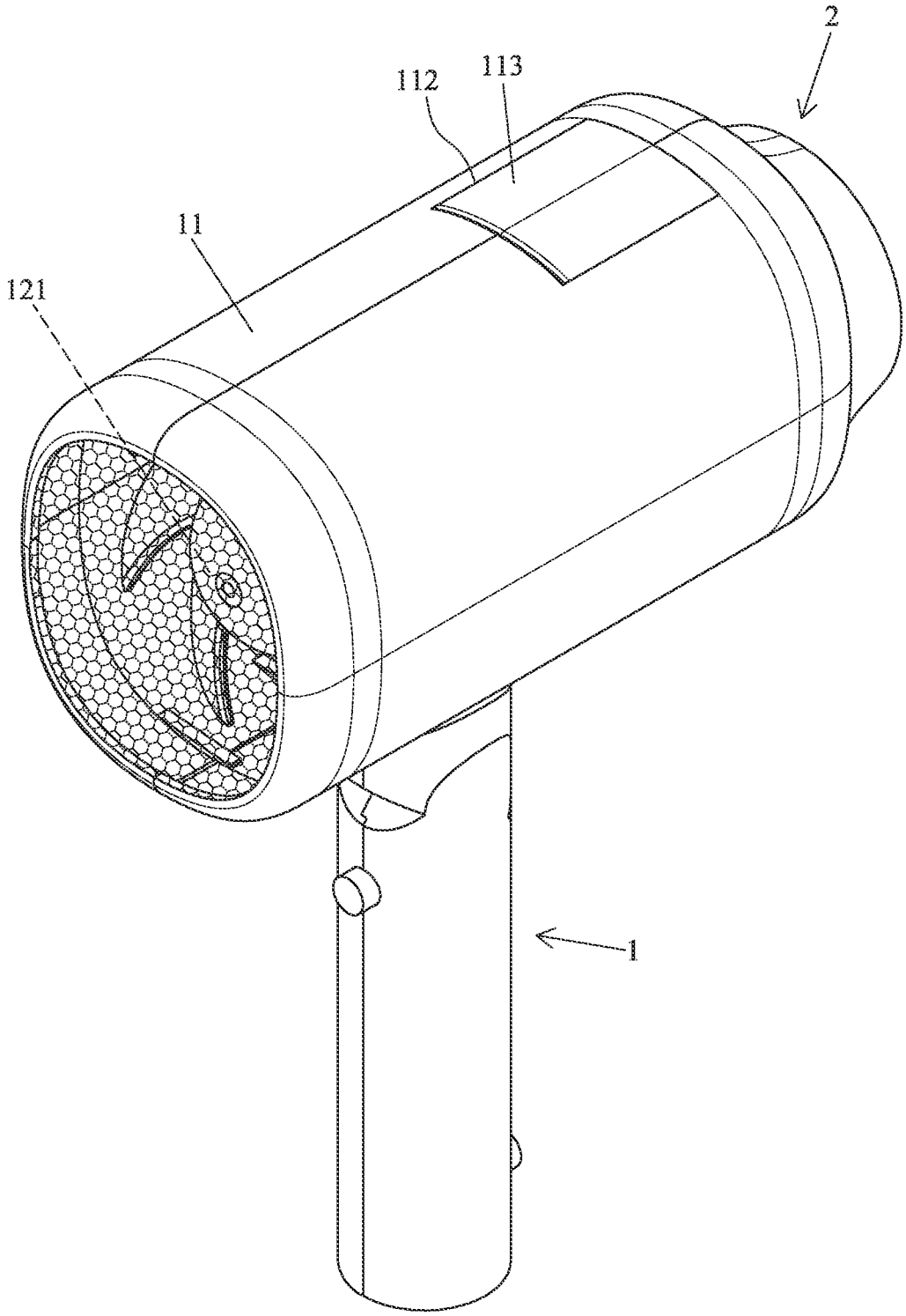
FIG. 3 is a perspective view of the hair dryer of the first embodiment according to the present invention.
Figure 4:
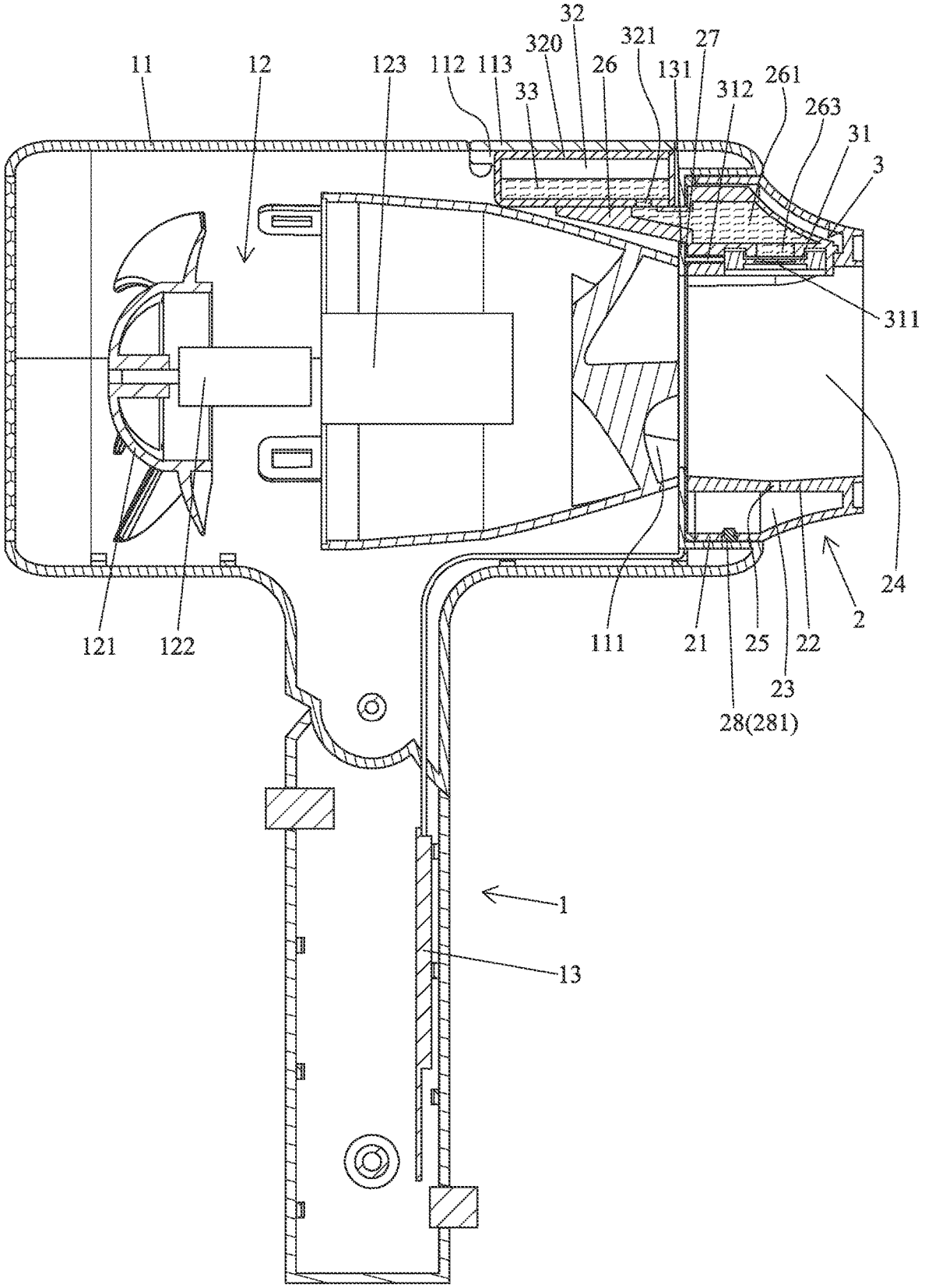
FIG. 4 is a cross sectional view of the hair dryer of the first embodiment according to the present invention after assembly.

Where used in the various figures of the drawings, the same numerals designate the same or similar parts. With reference to FIGS. 1-4, a hair dryer w of a first embodiment according to the present invention comprises a body 1, an annular cap 2, and an atomization device 3. The body 1 includes a housing 11, a heating and blowing device 12, and a control device 13. The housing 11 includes a front end having an air outlet 111 which is annular. The housing 11 includes an opening 112 at a top face of a front side thereof. A lid 113 is disposed at the opening 112 to open or close the opening 112. The heating and blowing device 12 is mounted in the housing 11 and includes a fan 121, a motor 122, and a heating device 123. The heating and blowing device 12 is configured to guide in ambient cold air, to heat the cold air, and to guide heated air out of the housing 11 via the air outlet 111. The control device 13 is disposed on the housing 11 and is configured to connect with a power. The control device 13 includes an electrically conductive magnetic ring 131 at a location corresponding to the air outlet 111. The control device 13 controls power supply to the heating and blowing device 12 and the electrically conductive magnetic ring 131, thereby controlling operation of the heating and blowing device 12 and the electrically conductive magnetic ring 131.

The annular cap 2 is disposed at the air outlet 111 of the body 1. The annular cap 2 includes an outer ring 21 coupled to the air outlet 111 of the body 1 and an inner ring 22 radially inwards of the outer ring 21. A collection groove 23 is formed between the outer ring 21 and the inner ring 22 and is annular and sealed. The inner ring 22 includes a central portion having a passageway 24 aligned with the air outlet 111. The outer ring 21 includes a lower end having a collecting hole 25 intercommunicating with the collection groove 23. A connecting seat 26 is disposed on an upper side of the annular cap 2 and is aligned with the opening 112 of the housing 11 of the body 1. The connecting seat 26 includes a guiding groove 261 at an upper side thereof and a connecting portion 262 at a lower side thereof. The connecting portion 262 includes a through-hole 263 communicating with the guiding groove 261. An electrically conductive board 27 is disposed at a rear end of the annular cap 2, is attracted to the electrically conductive magnetic ring 131, and covers the collection groove 23. The annular cap 2 includes a discharge hole 28 aligned with the collection groove 23. A plug 281 is received in the discharge hole 28.

The atomization device 3 includes an atomizer 31 and a chamber 32. The atomizer 31 is disposed on the connecting portion 262 of the connecting seat 26 of the annular cap 2 and includes a spray hole 311 configured to eject a spray towards the passageway 24. The atomizer 31 is electrically connected to the electrically conductive board 27 via a wire 312. The control device 13 of the body 1 can control operation of the atomizer 31. The chamber 32 is defined in a container 30 that is configured to receive a liquid 33, such as a hair conditioner, an essential oil, or a fragrant agent. The container 320 includes an outlet port 321. The container 320 can be disposed to a position below the opening 112 of the housing 11 of the body 1 via the opening 112. The outlet port 321 can guide the liquid 33 to the guiding groove 261, the through-hole 263 of the connecting portion 262, and the atomizer 31.

Figure 5:
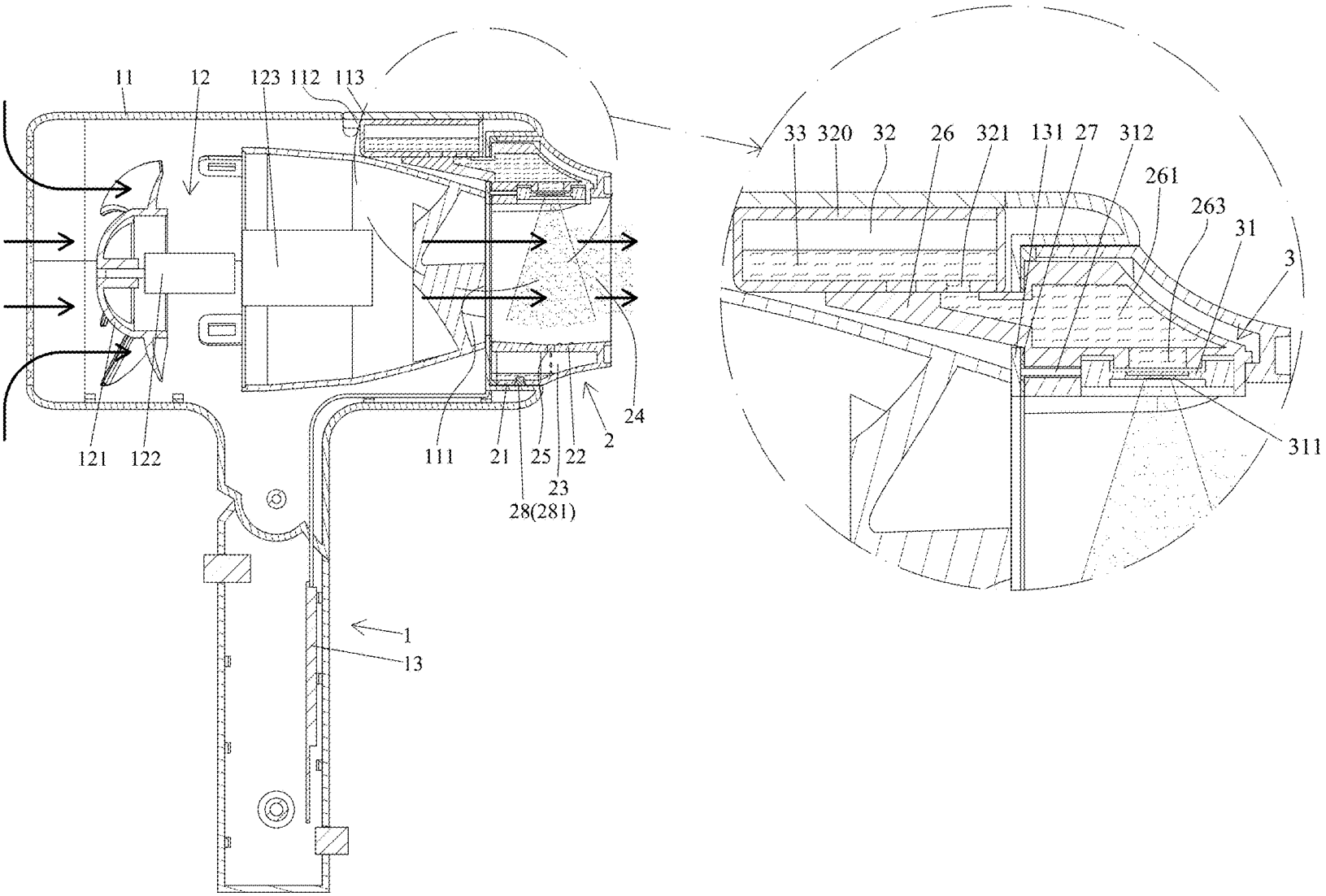
FIG. 5 is a cross sectional view illustrating operation of the hair dryer of the first embodiment according to the present invention.

With reference to FIG. 5, in use, the annular cap 2 is disposed at the air outlet 111 of the body 1, and the electrically conductive board 27 of the annular cap 2 is attracted to and electrically connected to the electrically conductive magnetic ring 131, providing convenient electrical connection. Furthermore, a proper liquid 33 is received in the chamber 32 of the container 320, the container 320 is placed into the housing 11 of the body 1 via the opening 112, and the lid 113 is then closed. The liquid 33 in the chamber 32 can be guided to the atomizer 31 via the outlet port 321.

A user can operate the control device 13 to simultaneously activate the heating and blowing device 12 and the atomizer 13. The liquid 33 in the chamber 32 is guided to the atomizer 31 and is atomized to form a spray mist at the spray bole 311. The spray mist is ejected downwards towards the passageway 24. The heating and blowing device 12 generates hot wind that is blown forwardly towards the air outlet 111 and the passageway 24. The hot wind is substantially perpendicular to the spray mist can further heat the atomized liquid 33 into smaller droplets that are blown to the hair and the inside of the hair at a faster speed so as to be absorbed by the skin and the hair, providing a better hair caring effect. The container 320 of the hair dryer according to the present invention can be easily removed to receive a proper liquid 33 (such as a hair conditioner), providing better applications.

In a case that a portion of the atomized liquid 33 ejected downwardly from the atomizer 31 is not delivered forward by the hot wind guided outward by of the body 1, the portion of the atomized liquid 33 can flow through the collecting hole 25 of the inner ring 22 of the annular cap 2 and can be collected in the collection groove 23. The plug 281 can be removed to collect the liquid 33 via the discharge hole 28 for reuse, providing a better economic effect.

Figure 6:
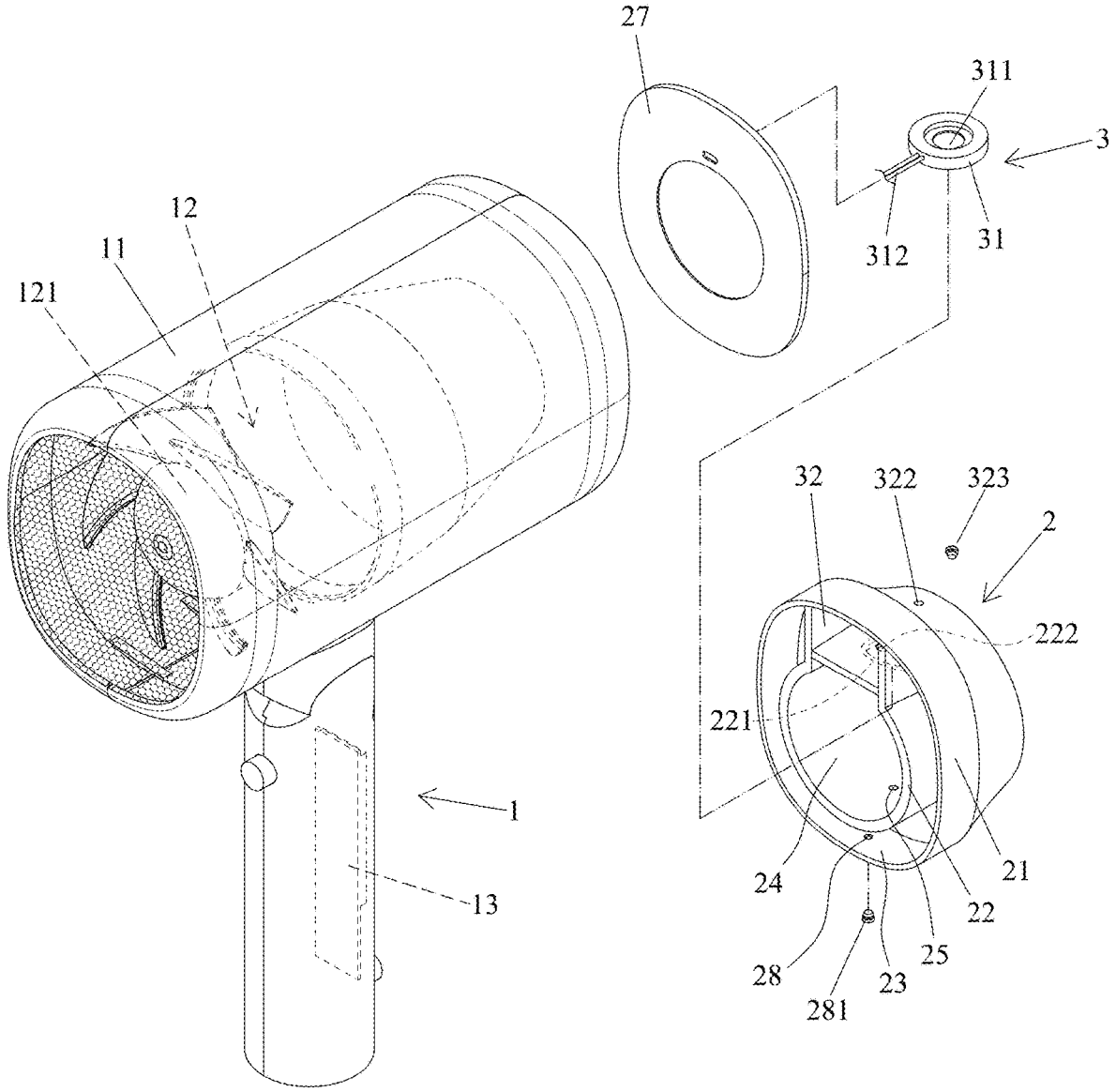
FIG. 6 is an exploded, perspective view of a hair dryer with an atomization device of a second embodiment according to the present invention.
Figure 7:
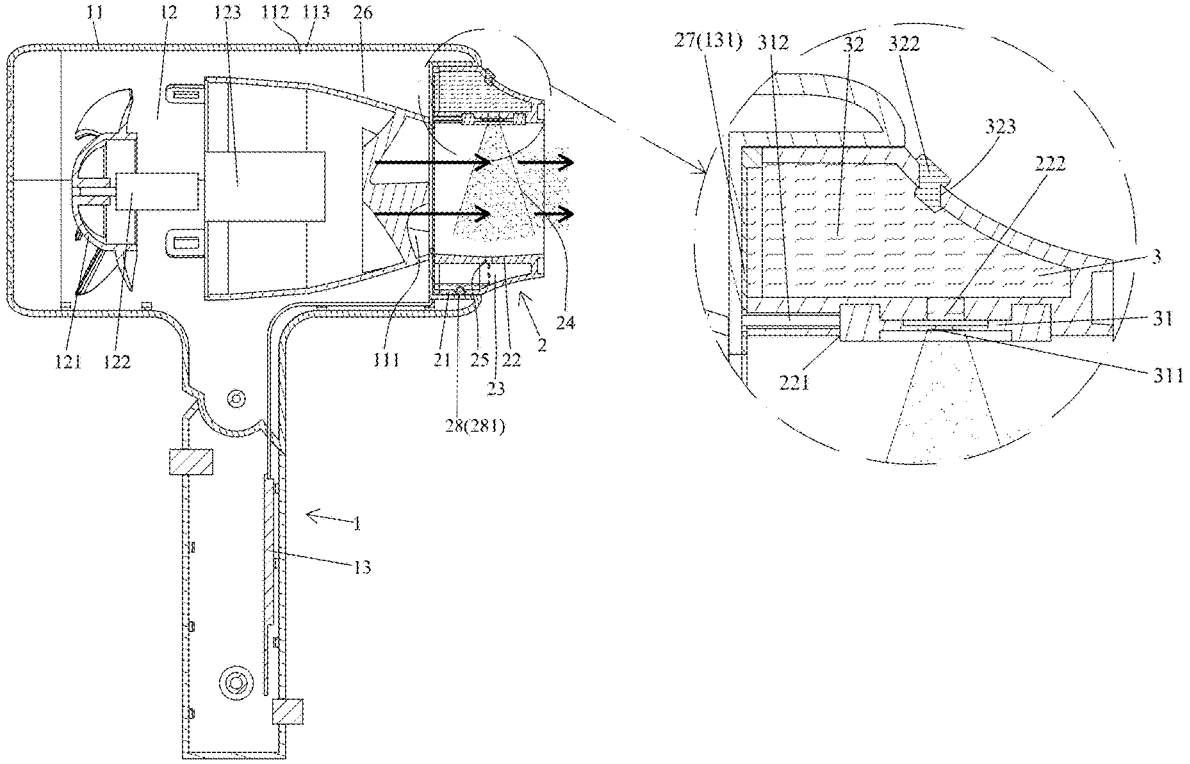
FIG. 7 is a cross sectional view of the hair dryer of the second embodiment according to the present invention.

FIGS. 6 and 7 show a hair dryer of a second embodiment according to the present invention which is similar to the first embodiment. The second embodiment is different from the first embodiment by that the collection groove 23 between the outer ring 21 and the inner ring 22 is received in the chamber 32. Furthermore, a filling port 322 is disposed in the outer ring 21 and intercommunicates with the chamber 32, and a plug 323 is disposed in the filling port 322. Furthermore, the inner ring 22 includes a connecting portion 221 for coupling with the atomizer 31. The connecting portion 221 includes a through-hole 222 intercommunicating with the chamber 32.

In the above embodiment, the user fills a liquid 33, such as a hair conditioner or an essential oil, into the chamber 32 via the filling port 322, and the plug 323 is placed into the filling port 322. The liquid 33 can flow through the through-hole 222 into the atomizer 31 for atomization and ejection of the atomized liquid.

In view of the above, the hair dryer according to the present invention can further minimize the size of the spray of the liquid 33 (such as a hair conditioner) by hot wind, so as to be more easily absorbed by the hair and skin. Furthermore, the spray mist is guided by a larger wind force to the deep portion of the hair to improve the hair-caring effect. Furthermore, the container 320 of the hair dryer according to the present invention can be easily removed to receive a proper liquid 33 (such as a hair conditioner), providing better applications while permitting recycling of the liquid 33 to increase the economic effect.

Although specific embodiments have been illustrated and described, numerous modifications and variations are still possible without departing from the scope of the invention. The scope of the invention is limited by the accompanying claims.

The invention claimed is:

1. A hair dryer comprising:

a body comprising:

a housing, wherein the housing includes a front end having an air outlet which is annular;

a heating and blowing device mounted in the housing and configured to guide in ambient cold air, to heat the cold air, and to guide heated air out of the housing via the air outlet and wherein the a control device configured to connect with a power source and configured to control operation of the heating and blowing device;

an annular cap disposed at the air outlet of the body, wherein the annular cap has a connecting portion and a central portion, the central portion having a passageway; and an atomization device comprising:

a chamber located within at least one of the body and the annular cap, the chamber configured to receive a liquid; and an atomizer disposed on the connecting portion of the annular cap, the atomizer electrically connected to the control device of the body via a wire, the atomizer having a spray hole in fluid communication with the chamber and the passageway;

wherein the atomizer forms a spray from the liquid in the chamber, wherein the spray is discharged through the spray hole towards the passageway.

2. The hair dryer as claimed in claim 1, wherein the annular cap further includes a connecting seat, wherein the housing includes an opening at a top face of a front side thereof, wherein a lid is disposed at the opening to open or close the opening, wherein the chamber is formed in a container disposed below the opening and having an outlet port for outputting the liquid, wherein the connecting seat is disposed on an upper side of the annular cap and is aligned with the opening of the housing of the body, wherein the connecting seat includes a guiding groove at an upper side thereof for guiding the liquid in the container, and wherein the connecting portion is disposed at a lower side of the connecting seat and includes a through-hole communicating with the guiding groove.

3. The hair dryer as claimed in claim 1, wherein the spray hole of the atomizer is configured to discharge the spray downwardly towards the passageway of the annular cap.

4. The hair dryer as claimed in claim 3, wherein the annular cap includes an outer ring coupled to the air outlet of the body and an inner ring radially inwards of the outer ring, wherein a collection groove is formed between the outer ring and the inner ring and is annular and sealed, wherein the outer ring includes a lower end having a collecting hole intercommunicating with the collection groove, wherein the annular cap includes a discharge hole aligned with the collection groove, and wherein a plug is received in the discharge hole.

5. The hair dryer as claimed in claim 1, wherein the control device of the body includes an electrically conductive magnetic ring at a location corresponding to the air outlet, and wherein an electrically conductive board is disposed at a rear end of the annular cap and is electrically connected to the electrically conductive magnetic ring and the wire of the atomizer.

6. The hair dryer as claimed in claim 1, wherein the annular cap includes an outer ring coupled to the air outlet of the body and an inner ring radially inwards of the outer ring, wherein a collection groove is formed between the outer ring and the inner ring and is annular and sealed, wherein the collection groove receives the chamber, wherein a filling port is disposed in the outer ring or the inner ring and intercommunicates with the chamber, wherein a plug is disposed in the filling port, and wherein the connecting portion is disposed on the inner ring and includes a through-hole intercommunicating with the chamber.

7. The hair dryer as claimed in claim 6, wherein the control device of the body includes an electrically conductive magnetic ring at a location corresponding to the air outlet, and wherein an electrically conductive board is disposed at a rear end of the annular cap and is electrically connected to the electrically conductive magnetic ring and the wire of the atomizer.

* * * * *